United States Patent [19]

Rossman

[11] 4,339,229

[45] Jul. 13, 1982

[54] ROTOR WHEEL FOR AXIAL-FLOW TURBOMACHINERY

[75] Inventor: Axel Rossman, Karlsfeld, Fed. Rep. of Germany

[73] Assignee: Motoren-und Turbinen-Union Munchen GmbH, Munich, Fed. Rep. of Germany

[21] Appl. No.: 137,873

[22] Filed: Apr. 7, 1980

[30] Foreign Application Priority Data

Apr. 14, 1979 [DE] Fed. Rep. of Germany ..... 2915201

[51] Int. Cl.[3] ..... F01D 5/30

[52] U.S. Cl. ..... 416/218; 416/230

[58] Field of Search ..... 416/218, 230, 241 A

[56] References Cited

U.S. PATENT DOCUMENTS 3,610,772 10/1971 Waggle ..... 416/218 X 4,008,000 2/1977 Gradl ..... 416/218 X

FOREIGN PATENT DOCUMENTS 2027861 12/1971 Fed. Rep. of Germany ..... 416/218

*Primary Examiner*—Leonard E. Smith

*Attorney, Agent, or Firm*—Alan H. Levine

[57] ABSTRACT

A rotor wheel, particularly for compressors, including a rotor disc and a plurality of radially-projecting metal blades arranged along the periphery of the disc. A plurality of locating rings, formed predominantly of directionalized fibers, are provided, each locating ring being adjacent to all the blade roots and serving to resist centrifugal loads on the blades. An attachment ring formed predominantly of undirectionalized fibers surrounds the periphery of the rotor disc, and all the blade roots and locating rings are embedded in the attachment ring. The attachment ring serves to attach the blades to the rotor disc. Each blade root may have a T-shape and each locating ring engages over the cross bar of the T of each root. Alternatively, each blade root may have a hole accommodating a pin, and each locating ring engages over the pin of each blade root. Each blade root may have a plurality of sections, a single pin passing through holes in all of the sections of each root.

6 Claims, 4 Drawing Figures

ROTOR WHEEL FOR AXIAL-FLOW TURBOMACHINERY

This invention relates to a rotor wheel for axial-flow turbomachinery, in particular compressors, and more particularly to such a rotor wheel having metal blades held by common co-axial locating rings of predominantly directionalized fibers, the rings serving to resist centrifugal loads.

Such a rotor wheel is shown in German Pat. No. 24 41 249 which corresponds to U.S. Pat. No. 4,008,000. However, the wheel of this patent must be made in comparatively large sizes in order to keep the manufacturing investment reasonable. In addition, it has proved difficult to maintain the concentric support of such a rotor in continuous operation.

Metal blades, which for aerodynamic reasons are extremely thin and sharp-edged, are rather susceptible to fatigue failure. It is, therefore, of prime importance to support the blade roots adequately. However, blades having such profiles cannot readily be made in fiber-reinforced material. Moreover, they are also extremely prone to erosion, and are sensitive to the impact of foreign objects.

It is an object of this invention to provide a rotor wheel for axial-flow turbomachinery, in particular compressors, wherein thin and sharp-edged metal blades are attached in a vibration-reduced manner, and wherein the rotor wheel can be made with reasonable investment even in relatively small sizes.

It is another object of the invention to provide such a rotor wheel wherein the blade roots and locating rings are embedded in an attachment ring, preferably formed predominantly of undirectionalized fibers, which serves to attach the blades to the rotor disc.

It is a further object of the invention to provide such a rotor wheel wherein each blade root is T-shaped, or furnished with a cross pin, each locating ring engaging over the cross bar of the T, or over the pin, of each root.

Various embodiments of the invention are shown in the drawings, in which.

Figure 1:
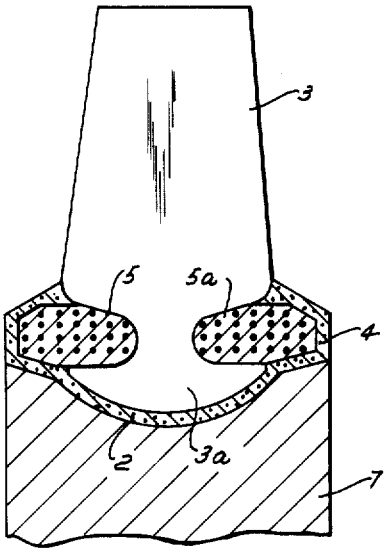
FIG. 1 is a longitudinal cross-sectional view of a rotor wheel employing dovetail-type attachment of the blades.

As shown in FIG. 1, the locating rings 5 and 5*a*, which are common to all the blades and are preferably made of directionalized fibers, engage recesses in both sides of the dovetail or T-shaped blade roots 3*a* to resist the centrifugal loads.

Figure 2:
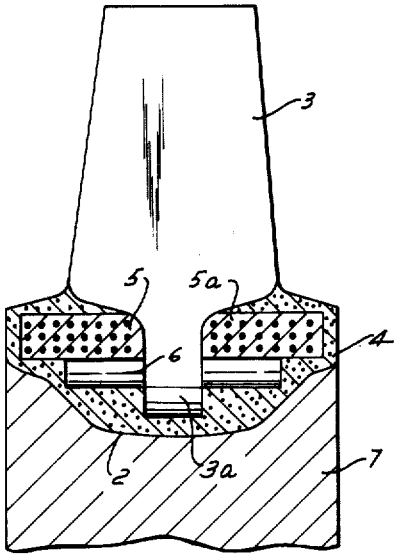
FIG. 2 is a longitudinal cross-sectional view of a rotor wheel employing bolt-type attachment of single-root blades.
Figure 3:
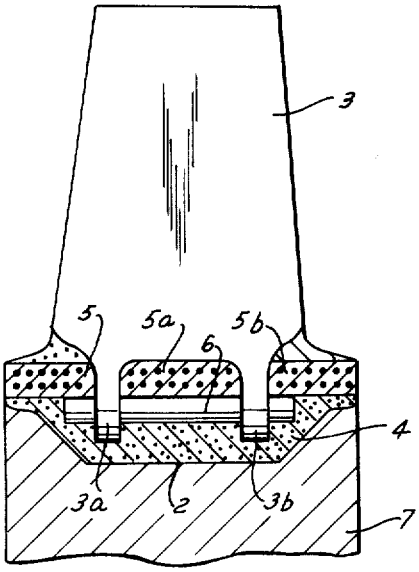
FIG. 3 is a longitudinal cross-sectional view of a rotor wheel employing bolt-type attachment of double-rooted blades.
Figure 4:
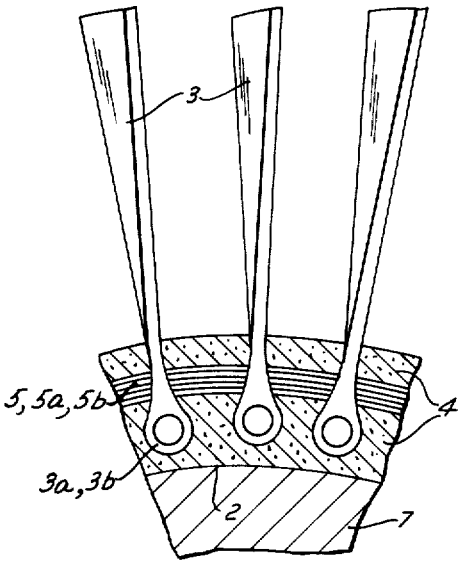
FIG. 4 is a cross-sectional view of the rotor wheel of FIG. 3.

As shown in FIGS. 2, 3, and 4, blade 3 is provided with a root 3*a* (FIG. 2), or two roots 3*a* and 3*b* (FIGS. 3 and 4), each root having a hole through which an axial pin 6 passes, the pin sections not accommodated within blade roots being directly embraced by common locating rings 5 and 5*a* (FIG. 2), or 5, 5*a*, and 5*b* (FIGS. 3 and 4), each ring consisting of directionalized fibers and serving to resist the centrifugal loads.

Common to all embodiments is the feature that the entire blade root area is embedded in a material, preferably consisting of undirectionalized fibers 4, in such a way that a ring 2 is formed, co-axial with rings 5, 5*a*, and 5*b*. Ring 2 in the radial inward direction, is shaped like a trough, this being achieved by pressing. In the case of fibers contained in a metallic matrix, e.g., consisting of boron or aluminium material, the shape is achieved by diffusion welding. Ring 2 serves for attachment of the blades to the rotor disc 7.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A rotor wheel for axial-flow turbomachinery comprising:

(a) a rotor disc, (b) a plurality of radially-projecting metal blades arranged along the periphery of the rotor disc, each blade having a root, (c) a plurality of locating rings coaxial with the rotor disc and formed predominantly of directionalized fibers, each locating ring being adjacent to all the blade roots and serving to resist centrifugal loads on the blades, and (d) a material within which all the blade roots and locating rings are embedded, the material forming a ring coaxial with the locating rings and serving to attach the blades to the rotor disc, and the material being between all the blade roots and the disc.

2. A rotor wheel as defined in claim 1 wherein the material is formed predominantly of undirectionalized fibers.

3. A rotor wheel as defined in claim 1 wherein the attachment ring has a radially-inwardly-directed trough shape.

4. A rotor wheel as defined in claim 1 wherein each blade root has a T-shape, and each locating ring engages over the cross bar of the T of each root.

5. A rotor wheel as defined in claim 1 wherein each blade root has a hole accommodating a pin, and each locating ring engages over the pin of each blade root.

6. A rotor wheel as defined in claim 5 wherein each blade root has a plurality of sections, the pin passing through holes in all the sections of each root.

* * * * *